US007831188B2

(12) United States Patent
Lee

(10) Patent No.: US 7,831,188 B2
(45) Date of Patent: Nov. 9, 2010

(54) IMAGE FORMING APPARATUS AND FUSING UNIT THEREOF

(75) Inventor: Bong Hee Lee, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 244 days.

(21) Appl. No.: 12/105,444

(22) Filed: Apr. 18, 2008

(65) Prior Publication Data

US 2008/0286018 A1 Nov. 20, 2008

(30) Foreign Application Priority Data

May 14, 2007 (KR) ..... 10-2007-0046730

(51) Int. Cl.
*G03G 15/20* (2006.01)

(52) U.S. Cl. ..... 399/329

(58) Field of Classification Search ..... 399/329, 399/33

See application file for complete search history.

(56) References Cited

U.S. PATENT DOCUMENTS 6,091,926 A * 7/2000 Yamada ..... 399/329
6,459,877 B1 10/2002 Yoda et al.
2002/0057919 A1 5/2002 Tomatsu
2003/0039492 A1 2/2003 Hamada et al.
2004/0179876 A1 9/2004 Fuma et al.
2005/0123328 A1 6/2005 Aruga et al.
2006/0165447 A1 * 7/2006 Onodera ..... 399/329
2007/0059061 A1 * 3/2007 Katayama et al. ..... 399/329

FOREIGN PATENT DOCUMENTS

JP 2006-178089 7/2006

OTHER PUBLICATIONS

European Search Report dated Aug. 6, 2008 in EP08155124.4.

* cited by examiner

*Primary Examiner*—Sandra L Brase
(74) *Attorney, Agent, or Firm*—Stanzione & Kim LLP

(57) ABSTRACT

An image forming apparatus and a fusing unit thereof. The image forming apparatus includes a photosensitive body on which to form an electrostatic latent image, an exposure device to irradiate light to the photosensitive body to form the electrostatic latent image, a developer adhering device to adhere a developer to the photosensitive body on which the electrostatic latent image has been formed to form a visible image, a transfer device to transfer the visible image formed on the photosensitive body onto a printing medium, and a fusing unit to fuse the visible image transferred onto the printing medium to the printing medium. The fusing unit includes a press roller, a heating belt to closely contact the press roller to form a fusing nip to apply heat and pressure to the printing medium onto which the visible image has been transferred, first and second support rollers disposed apart from each other to circulatingly support the heating belt, and an elastic support device to elastically bias the first support roller and/or the second support roller in a direction away from each other to maintain a constant tension of the heating belt.

20 Claims, 6 Drawing Sheets

IMAGE FORMING APPARATUS AND FUSING UNIT THEREOF

CROSS-REFERENCE TO RELATED APPLICATIONS

This application claims the benefit and priority under 35 U.S.C. § 119(a) of Korean Patent Application No. 2007-0046730, filed on May 14, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to an electrophotographic image forming apparatus and a fusing unit thereof.

2. Description of the Related Art

An image forming apparatus is an apparatus that prints a black and white image or a color image on a printing medium, e.g., printing paper, according to an inputted image signal, and may be, for example, a laser printer, an ink-jet printer, a copying machine, a multi-function printer, a fax machine, etc. An image forming apparatus is classified as an electrophotographic type in which light is irradiated to a photosensitive body to form an electrostatic latent image and a developer adheres to the electrostatic latent image to transfer the same onto a printing medium, or an ink-jet type in which a liquid type ink is ejected onto a surface of a printing medium according to an image signal.

The electrophotographic image forming apparatus is configured such that a surface of a photosensitive body is charged with a predetermined electric potential, a light beam is scanned to the photosensitive body to form an electrostatic latent image due to generation of electric potential difference, and a developer, i.e., a toner powder, adheres to the electrostatic latent image to form a visible image. The visible image formed on the photosensitive body is transferred onto the printing medium, and is fused to the surface of the printing medium.

In order to fuse the visible image formed by the toner powder of the developer to the surface of the printing medium, the electrophotographic image forming apparatus has a fusing unit which applies heat and pressure to the printing medium onto which the visible image has been transferred.

The fusing unit generally includes a heating roller which generates heat of a high temperature, and a press roller which is mounted to closely contact the heating roller. The heating roller includes a heat source such as a lamp, a heating element or the like, an aluminum pipe provided around the heat source, and a release layer provided on the surface of the aluminum pipe. The press roller is provided with an elastic layer on its outer surface, and is in close contact with the heating roller. During the printing operation, the visible image-transferred printing medium receives heat and pressure while passing between the heating roller and the press roller, and the visible image is fused to the surface of the printing medium.

However, in a fusing unit arranged such that the press roller and the heating roller directly contact each other, there is a limitation in a size of a fusing nip formed between the heating roller and the press roller. Because the heating roller is typically made of a metal such as aluminum, although the elastic layer of the press roller is deformed by closely contacting the heating roller, the contact area between two rollers is limited.

The large heating area and pressing area in the fusing unit are favorable for the smooth fusing of the visible image. If the size of the fusing nip is small, a fusing efficiency may be decreased. In order to increase the size of the fusing nip, it may be considered to increase diameters of the heating roller and the press roller. This, however, results in the increase in a mounting space of the fusing unit and an increase in an overall size and cost of the image forming apparatus.

To cope with the above problem, a fusing unit capable of increasing a size of a fusing nip using a heating belt has been developed and used. The fusing unit using the heating belt is arranged such that the heating belt contacts the press roller while circulating by being supported on plural rollers. The rollers supporting the heating belt include a heating roller which heats the heating belt, and a driving roller which rotates by receiving a driving force. The driving roller has an elastic layer, and is mounted to closely contact the press roller. Thus, if the driving roller and the press roller closely contact each other, the elastic layers of the respective rollers are deformed, and the contact area therebetween is increased. The fusing nip between the heating belt and the press roller is also increased, thereby improving the fusing efficiency.

The so-called belt type fusing unit should have a tension adjusting device to maintain a constant tension of the heating belt, which is supported on the plural rollers. This is to enable the heating belt to smoothly circulate without slipping on the driving roller.

The conventional belt type fusing unit uses a tension roller which presses on one side of the belt, similarly to a common belt device, to maintain the constant tension of the heating belt. The tension roller is mounted such that a pressing force is changed. In order to prevent the contamination of the tension roller due to foreign substances adhering to the heating belt, a cleaning roller is mounted to contact the heating belt to remove foreign substances from the heating belt. However, if the number of rollers rotating while contacting the heating belt is increased, a resistance to the circulation of the heating belt is also increased. Further, the installation of the expensive tension roller and cleaning roller increases a manufacturing cost, and the increased number of rollers causes a high frequency of operational trouble.

SUMMARY OF THE INVENTION

The present general inventive concept provides an image forming apparatus and a fusing unit thereof that is capable of maintaining a constant tension of a heating belt while decreasing the number of rollers contacting the heating belt.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including a photosensitive body to form an electrostatic latent image, an exposure device to irradiate light to the photosensitive body to form the electrostatic latent image, a developer adhering device to adhere a developer to the photosensitive body, on which the electrostatic latent image has been formed, to form a visible image, a transfer device to transfer the visible image formed on the photosensitive body onto a printing medium, and a fusing unit which includes a press roller, a heating belt to closely contact the press roller to form a fusing nip to apply heat and pressure to the printing medium onto which the visible image has been transferred, first and second support rollers disposed apart from each other to circulatingly support the heating belt, and an elastic support device to elastically bias the first support roller and/or the second support roller in a direction away from each other to maintain a substantially constant tension of the heating belt.

The elastic support device may be configured as a tension spring to pull the first support roller and/or the second support roller away from each other, or a compression spring to push the first support roller and/or the second support roller away from each other.

The image forming apparatus may further include a fixing frame to rotatably support the first support roller, and a moving frame to rotatably support the second support roller and is slidably coupled to the fixing frame, where the elastic support device may elastically support the moving frame to bias the second support roller away from the first support roller.

One of the fixing frame and the moving frame may be provided with a guide rail, and the other may be provided with a guide rib to slidably guide the guide rail.

The elastic support device may be mounted in plural numbers at respective end portions of the fixing frame and the moving frame.

The second support roller may be provided with a connecting pipe at a respective end portion, and each connecting pipe may be respectively rotatably coupled to a corresponding end portion of the moving frame, and may be provided with a belt guide portion to guide a respective side of the heating belt to allow the heating belt to circulate without the heating belt being biased to one side of the second support roller.

The second support roller may be configured as a hollow pipe, and the heater may be mounted in an interior portion of the second support roller.

The first support roller may be provided with an elastic layer on a surface thereof, the elastic layer being elastically deformed when closely contacting the press roller.

The foregoing and/or other aspects and utilities of the present general inventive concept may also be achieved by providing a fusing unit of an image forming apparatus, including a press roller, a heating belt to closely contact the press roller to form a fusing nip to apply heat and pressure to the printing medium onto which the visible image has been transferred, first and second support rollers disposed apart from each other to circulatingly support the heating belt, and an elastic support device to elastically bias the first support roller and/or the second support roller in a direction away from each other to maintain a substantially constant tension of the heating belt.

The elastic support device may be mounted in plural numbers to a respective first and second end portion of the fixing frame and the moving frame.

The second support roller may be provided with a connecting pipe on a first and second end portion of the second support roller, and each connecting pipe is respectively rotatably coupled to a respective first and second end portion of the moving frame, and are provided with belt guide portions to guide each side of the heating belt to circulate without being biased to either side of the second support roller.

The foregoing and/or other aspects and utilities of the present general inventive concept may also be achieved by providing an image forming apparatus, including an image forming unit to form a visible image to be printed on a printing medium, a fusing unit to fuse the visible image on the printing medium and including a heating belt and a tension adjusting unit, the tension adjusting unit having a plurality of support rollers to support and circulate the heating belt such that one of the support rollers provides the heating belt with a bias force to maintain a substantially constant tension on the heating belt.

The fusing unit may include a plurality of frames coupled to corresponding ones of the plurality of support rollers to move with respect to each other, and a sensor unit extended from one of the plurality of frames to be disposed close to the heating belt to detect a temperature of the heating belt.

The support rollers are moved away from each other via the bias force which is a pushing bias force.

The support rollers are moved away from each other via the bias force which is a pulling bias force.

The image forming apparatus may further include a temperature sensing unit to sense a temperature of the circulating heating belt.

The image forming apparatus may further include a heating unit to provide heat to the circulating heating belt such when the sensed temperature of the circulating heating belt is greater than a predetermined value, the heating unit automatically ceases operation.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
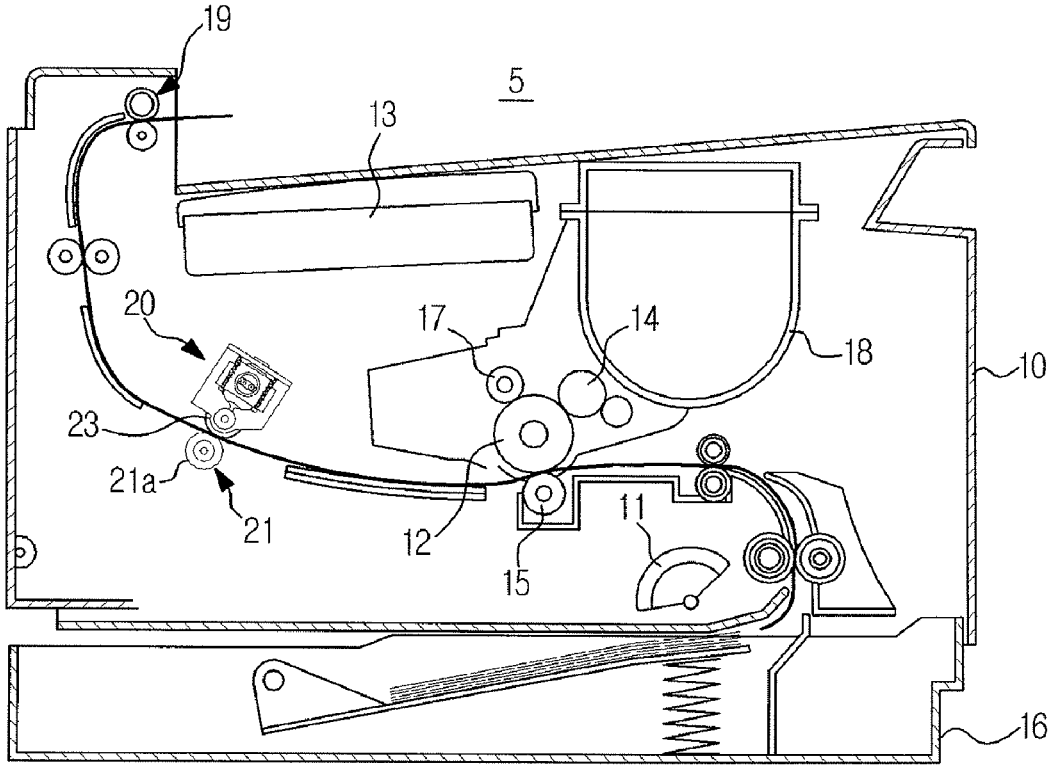
FIG. 1 is a side-sectional view schematically illustrating an image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

As illustrated in FIG. 1, an image forming apparatus 5 according to an embodiment of the present general inventive concept includes a main body 10 which forms an external appearance of the image forming apparatus 5, a pickup device 11 which picks up a printing medium sheet by sheet, a photosensitive body 12 on which an electrostatic latent image is formed, an exposure unit 13 which irradiates light to the photosensitive body 12 according to an image signal, a developer adhering device 14 which adheres a developer, which may be, for example, a developer powder, to the photosensitive body 12 on which the electrostatic latent image has been formed, a transfer device 15 which transfers a visible image formed on the photosensitive body 12 onto the printing medium, and a fusing unit 20 which fuses the visible image transferred onto the printing medium. The main body 10 of the image forming apparatus may include a printing medium loading device 16 on which the printing medium is loaded, a charge device 17 which provides the photosensitive body 12 with a constant electric potential, a developer storage container 18 which stores the developer, a printing medium discharge device 19 which discharges the printing medium which has been printed to the outside of the image forming apparatus 5, a driving source (not illustrated) to generate a driving force, a power supply device (not illustrated) to supply electric power, and a control device (not illustrated) to control the operation of the image forming apparatus 5. The above description of component of the image forming apparatus may be referred to as an image forming unit to form a visible image to be printed on, or transferred to, a printing medium.

When the printing operation of the image forming apparatus 5 of the present general inventive concept is started, the pickup device 11 picks up the printing medium loaded on the printing medium loading device 16 sheet by sheet, and feeds the same to the photosensitive body 12. The light generated from the exposure device 13 is irradiated onto the surface of the photosensitive body 12, which has been charged with a constant electric potential by the charge device 17, according to an image signal, and an electrostatic latent image is formed on the photosensitive body 12. The developer adheres to the electrostatic latent image region by the developer adhering device 14, and a visible image is formed by developer. The visible image is transferred onto the surface of the printing medium by the transfer device 15, and is fused to the surface of the printing medium when the printing medium passes through the fusing unit 20. The printing medium on which the image has been printed is discharged to the outside of the main body 10 by the printing medium discharge device 19.

The above-described printing operation may be similar to an operation of a conventional electrophotographic image forming apparatus, and the components thereof, other than for the fusing unit 20, may be similar to the components of a conventional image forming apparatus. However, the fusing unit 20 of the image forming apparatus according to the present embodiment is different from a fusing unit of the conventional electrophotographic image forming apparatus.

Figure 2:
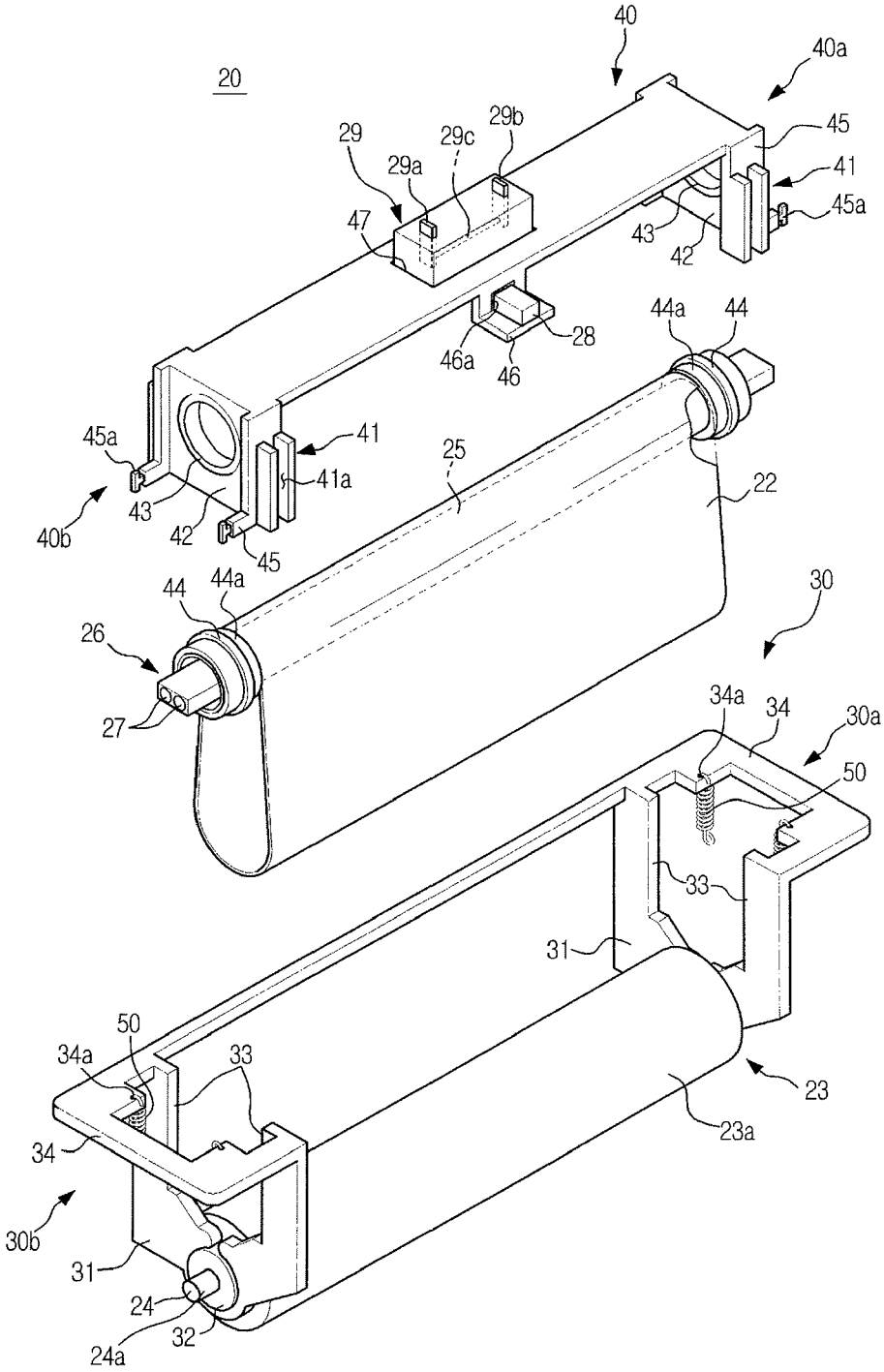
FIG. 2 is an exploded perspective view schematically illustrating components of a fusing unit of the image forming apparatus in accordance with an embodiment of the present general inventive concept of FIG. 1.

Referring to FIGS. 1 and 2, the fusing unit 20 may include a press roller 21 which has an elastic layer 21*a* on its surface, and a heating belt 22 which circulates while closely contacting the press roller 21. A fusing nip N (referring to FIG. 4) is formed between the press roller 21 and the heating belt 22. When the visible image-transferred printing medium passes through the fusing nip N, the visible image is fused to the surface of the printing medium by being applied with heat and pressure. The heating belt 22 is circulatingly supported on a first support roller 23 and a second support roller 25.

Figure 3:
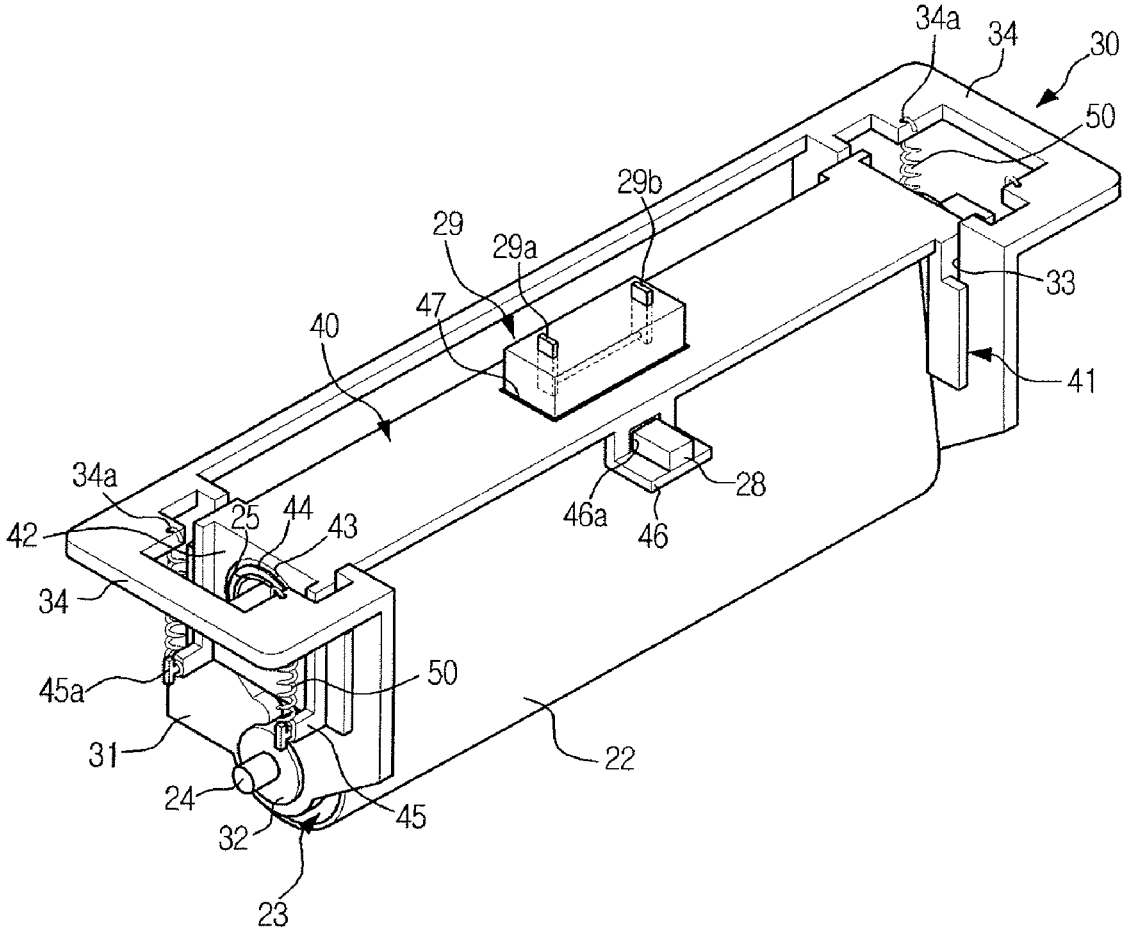
FIG. 3 is a perspective view schematically illustrating components of the fusing unit of the image forming apparatus in accordance with an embodiment of the present general inventive concept of FIG. 1.

As illustrated in FIGS. 2 and 3, the first support roller 23 is rotatably mounted to a fixing frame 30, and the second support roller 25 is rotatably mounted to a moving frame 40 which is movably mounted to the fixing frame 30. The first support roller 23 has an elastic layer 23*a* on its surface, which may be made of a rubber material or the like, so that the elastic layer 23*a* is elastically deformed when the first support roller 23 closely contacts the heating belt 22 toward the press roller 21. Accordingly, when the first support roller 23 closely contacts the heating belt 22 toward the press roller 21, the elastic layers 21*a* and 23*a* of the respective rollers 21 and 23 are elastically deformed (referring to FIGS. 4 and 5), and thus a contact area between two rollers 21 and 23 is increased. The second support roller 25 may be configured as a hollow metal pipe (e.g., an aluminum pipe).

Referring to FIGS. 2 and 3, a support bracket 31 is provided at each of the first and second end portions 30*a* and 30*b* of the fixing frame 30, and a bearing 32, which may be a plurality of bearing elements to provide a low friction rotation of the first support roller 23, is mounted to each of the respective support brackets 31 on each of the first and second end portions 30*a* and 30*b*. An end 24*a* of a driving shaft 24 protrudes from each end of the first support roller 23 and each end 24*a* is respectively coupled to a bearing 32, so that the first support roller 23 is rotatably supported by the support brackets 31. Either end 24*a* of the driving shaft 24 may be connected to the driving source (not illustrated). The driving shaft 24 is disposed along a center axis of the first support roller 23. Therefore, when the driving source operates, the first support roller 23 rotates. Each of the support brackets 31 is provided with a pair of guide ribs 33 which oppose each other, that is, the pair of guide ribs 33 are disposed on opposite sides of each respective end portion 30*a* and 30*b* of each respective support bracket 31. The guide ribs 33 guide an up/down sliding motion of the moving frame 40 within the support brackets 31.

Each of the support brackets 31 is provided with a support rib 34. The support rib 34 extends outward from each respective support bracket 31 so as to form a space between the support rib 34 and the respective guide rib 33 of the respective support bracket 31. Each support rib 34 may be provided with a pair of fixing holes 34*a*. One end of an elastic support device 50, which may be a spring or other device which applies an elastic force, may be fixedly attached to each fixing hole 34*a* of the support rib 34. The configuration and operation of the elastic support device 50 will be explained below.

The moving frame 40 is coupled to the fixing frame 30, and can slide up and/or down with respect to the fixing frame 30 by a predetermined distance. A pair of guide rails 41 may be provided at each of the respective end portions 40*a* and 40*b* of the moving frame 40, correspondingly to the guide ribs 33 of the fixing frame 30. When coupling the fixing frame 30 with the moving frame 40, the guide rails 41 are coupled to the respectively corresponding guide ribs 33. The guide ribs 33 are inserted into a corresponding guide slot 41*a* of the guide rails 41. When the moving frame 40 moves up and/or down within the fixing frame 30, the guide rails 41 guide the moving frame 40 by sliding along the guide ribs 33.

Bearing support portions 42, in which corresponding bearings 43 are mounted, where the bearings 43 may each be a plurality of bearing elements to provide a low friction rotation of the second support roller 25, are respectively provided at first and second end portions 40*a* and 40*b* of the moving frame 40. The pair of bearing support portions 42 rotatably supports both ends of the second support roller 25. Connecting pipes 44, which are respectively coupled on both end portions of the second support roller 25, are rotatably coupled with the corresponding bearings 43 mounted in the respective bearing support portions 42. Thus, in operation, the second support roller 25 rotates together with the connecting pipes 44. The connecting pipes 44 are respectively provided with belt guide portions 44*a*, each of which may have a diameter larger than a diameter of the second support roller 25. The belt guide portions 44*a* guide respective sides of the heating belt 22 so that the heating belt 22 can circulate on a center portion of the second support roller 25 without being biased to either side of the second support roller 25.

As described above, the second support roller 25 may be configured as a hollow metal pipe. A heater 26 may be mounted inside the second support roller 25 to heat the second support roller 25. The heater 26 may not be in contact with the inner surface of the second support roller 25, and may be fixedly mounted in the main body 10 so as not to rotate with the second support roller 25. The heater 26 may be provided with a heating lamp 27 which is applied with electric power from the power supply device (not illustrated) to generate heat. Besides the heating lamp 27, the heater 26 may be provided with other heating members, such as an electric heating wire (not illustrated) to generate heat by receiving electric power. The heat generated from the heater 26 is transferred to the heating belt 22 through the second support roller 25.

The moving frame 40 may be provided with connecting ribs 45 which are respectively formed in pairs at both end portions 40*a* and 40*b* of the moving frame 40. The connecting ribs 45 may extend outwardly from the bearing support portions 42. The connecting ribs 45 of each pair on each respective end portion 40*a* and 40*b* may be disposed opposite to each other while interposing the bearing 43 therebetween. Each of the connecting ribs 45 may be provided with a coupling protrusion 45*a* to which an end of the elastic support device 50 is coupled.

One end of each elastic support device 50 may be attached to the fixing frame 30 through a respective fixing hole 34*a* of the fixing frame 30, and an opposite end of each elastic support device 50 may be coupled to the moving frame 40 through a respective coupling protrusion 45*a* of the moving frame 40. The moving frame 40 is elastically supported by the fixing frame 30 through the elastic support devices 50. Accordingly, the second support roller 25 mounted to the moving frame 40 is biased away from the first support roller 23 mounted to the fixing frame 30, and is at a predetermined distance from the first support roller 23. As illustrated in FIGS. 2-5, the elastic support devices 50 may be configured as a tension spring which pulls the moving frame 40 toward the support ribs 34 of the fixing frame 70, or other similar elastic device.

Referring to FIGS. 2 and 3, a temperature sensor 28, to detect a temperature of the heating belt 22, and an overheating prevention device 29, to automatically interrupt electric power applied to the heater 26 when the temperature of the heating belt 22 is determined to be greater than a predetermined value, may be mounted to the moving frame 40. The temperature sensor 28 may be mounted on a holder 46 provided at one side of the moving frame 40, and the overheating prevention device 29 may be mounted through a mounting hole 47 provided on a top surface of the moving frame, and may be provided at the substantially center portion of the moving frame 40.

Figure 4:
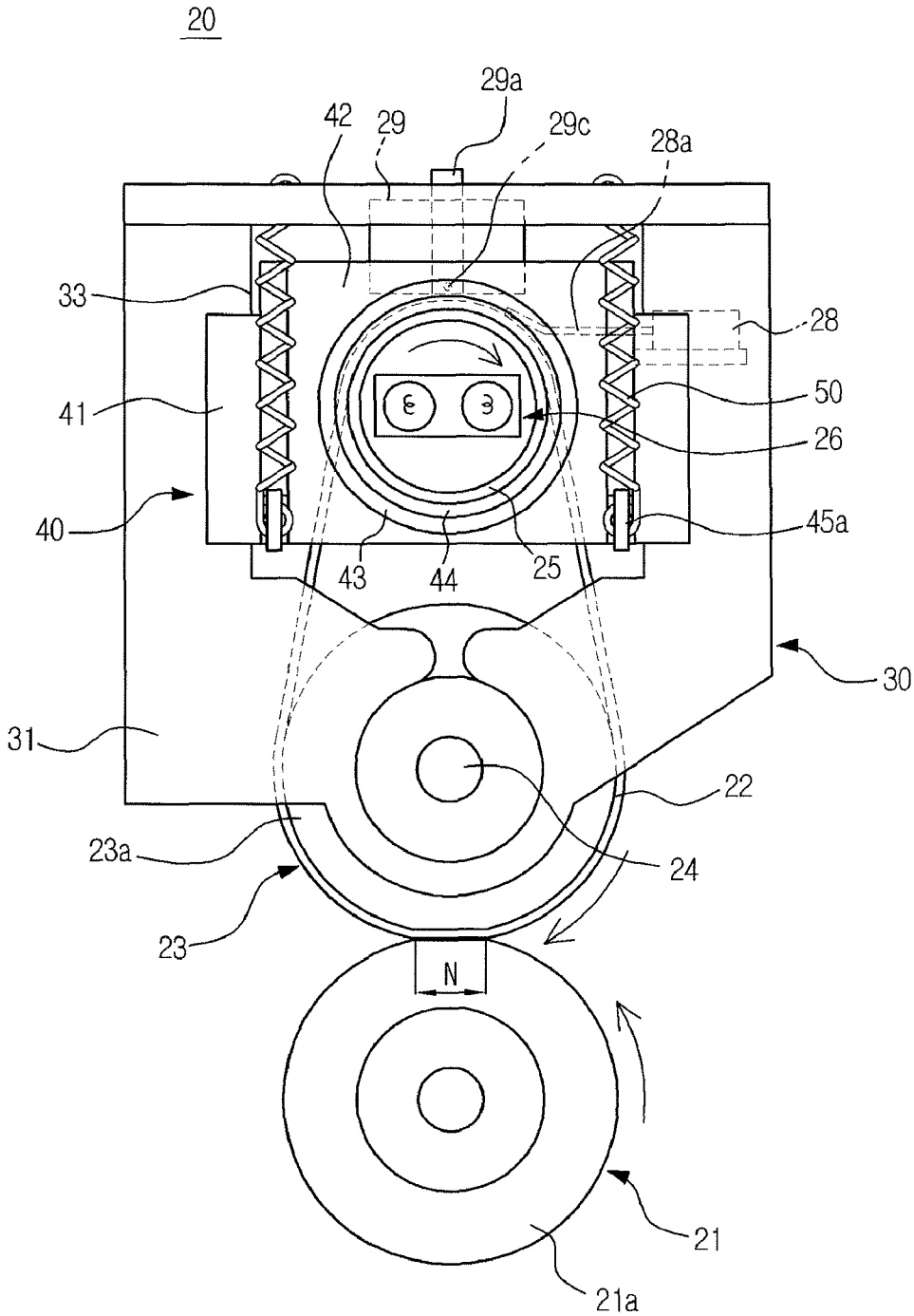
FIGS. 4 and 5 are side views illustrating an operation of the fusing unit of the image forming apparatus in accordance with an embodiment of the present general inventive concept of FIG. 1.

As illustrated in FIG. 4, the temperature sensor 28 may have a sensing bar 28*a* which extends to the interior of the moving frame 40 through a sensing hole 46*a* (referring to FIGS. 2 and 3) provided at the holder 46 to contact the surface of the heating belt 22. The temperature sensor 28 detects the surface temperature of the heating belt 22 through the sensing bar 28*a*, and transmits the detecting signal to the control device (not illustrated). In response to the detecting signal from the temperature sensor 28, the control device (not illustrated) may control the operation of the heater 26 according to the detecting signal received from the temperature sensor 28 which indicates a temperature of the heating belt 22. The sensing bar 28*a* may be configured as a non-contact type which does not directly contact the heating belt 22, but which is disposed in close proximity to the surface of the heating belt 22 to be able to detect the temperature of the heating belt 22.

As illustrated in FIGS. 2 and 3, the overheating prevention device 29 may have plural power terminals 29*a* and 29*b* for connection to the power supply device (not illustrated), and a fuse 29*c* to connect to the power terminals 29*a* and 29*b*. One of the plural power terminals 29*a* and 29*b* may be connected to the heater 26, and the other one may be connected to the power supply device (not illustrated).

As illustrated in FIG. 4, a portion of the overheating prevention device 29, in which the fuse 29*c* is provided, may be positioned to be in close proximity to, the heating belt 22. Accordingly, if the temperature of the heating belt 22 becomes greater than a predetermined value, that is, if it overheats, the fuse 29*c* automatically interrupts the electric power supplied to the heater 26, for example, by melting due to the heat dissipated from the heating belt 22. The overheating prevention device 29 may otherwise be configured as a contact type device which directly contacts the heating belt 22 to detect the temperature of the heating belt 22. The fuse 29*c* of the overheating prevention device 29 can be substituted by any other device which can automatically and quickly disconnect the power supply between the heater 26 and the power supply device by being deformed or broken when overheating occurs, or by other means to disconnect the power supply.

Hereinafter, the operation of the fusing unit 20 according to an embodiment of the present general inventive concept will be described with reference to FIGS. 4 and 5. In a normal state, in which the printing operation is normally performed, the heating belt 22 is supported on the first support roller 23 and the second support roller 25 and circulates in one direction (e.g., in the clockwise direction, as indicated in FIG. 4). The first support roller 23 is pressed toward the press roller 21, and the elastic layer 23*a* of the first support roller 23 and the elastic layer 21*a* of the press roller 21 are elastically deformed. The heating belt 22 pressed toward the press roller 21 by the first support roller 23 closely contacts the surface of the press roller 21, and the fusing nip N is formed between the heating belt 22 and the press roller 21. When the visible image-transferred printing medium passes through the fusing nip N, the printing medium is applied with heat and pressure. The moving frame 40 is biased upward (referring to direction arrows A of FIG. 5) by an elastic force applied by the elastic support devices 50 which are elastically deformed, and thus the second support roller 25 moves away from the first support roller 23 to tighten the heating belt 22.

During the printing operation, the first support roller 23 is applied with a driving force and rotates in the clockwise direction, and the press roller 21 rotates in the counterclockwise direction (as indicated in FIG. 4). By the rotation of the first support roller 23, the heating belt 22 circulates in the clockwise direction, and the second support roller 25 also rotates in the clockwise direction. The electric power is provided to the heater 26, and the heat generated from the heater 26 is transferred to the heating belt 22 through the second support roller 25. Accordingly, when the visible image-transferred printing medium passes through the fusing nip N, the visible image is applied with heat and pressure, and is fused to the surface of the printing medium. During the printing operation, the temperature sensor 28 detects the temperature of the heating belt 22, and transmits the detecting signal to the control device. In response to the detecting signal from the temperature sensor 28, the control device controls the operation of the heater 26, such that if the detecting signal indicates that the temperature of the heating belt 22 is greater than a predetermined value during the printing operation, the fuse 29*c* of the overheating prevention device 29 automatically disconnects the power supply to the heater 26, as described above, thereby stopping the printing operation.

Figure 5:
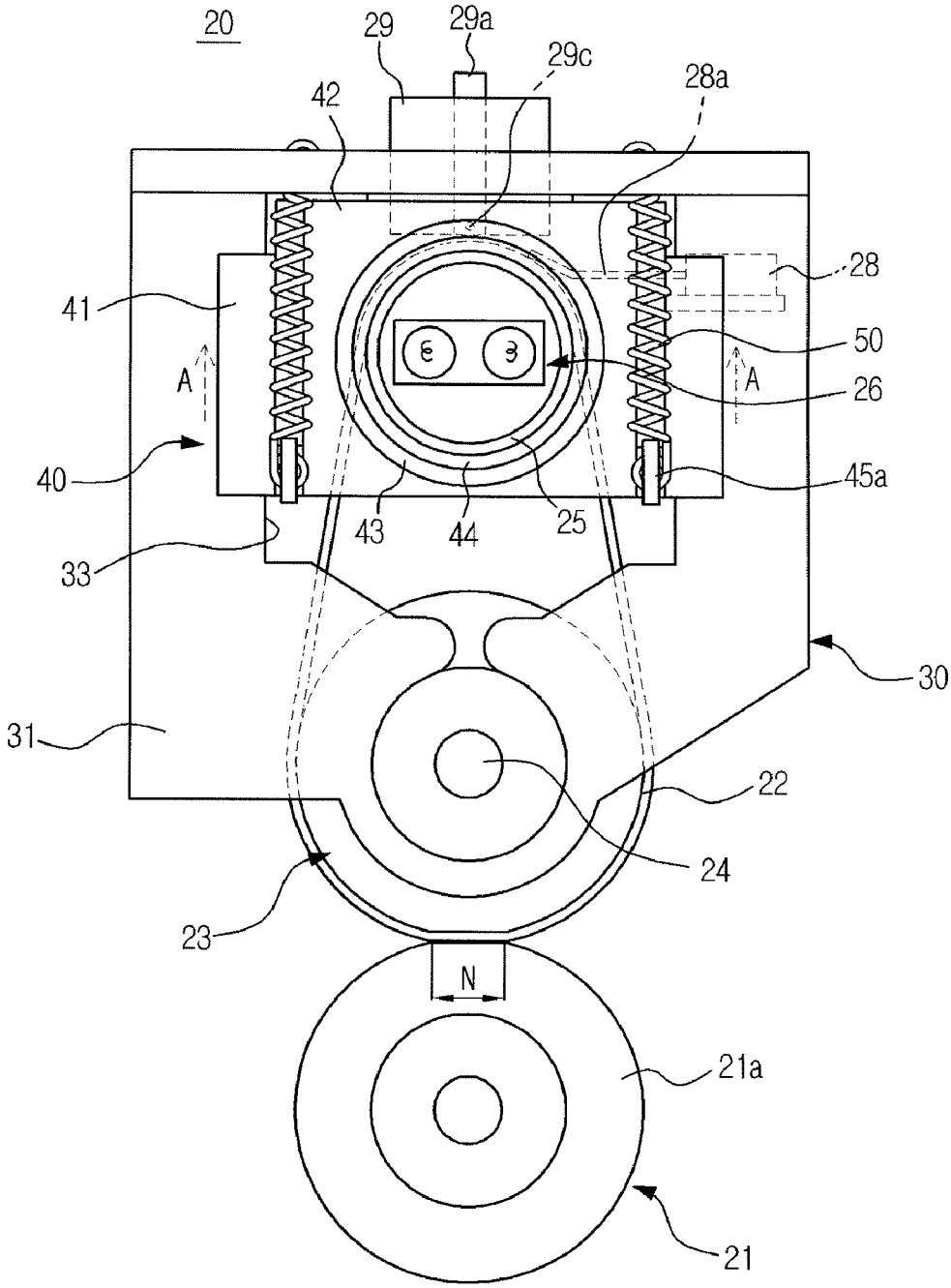

As illustrated in FIG. 5, if the heating belt 22 becomes loose during the printing operation, the elastic support device 50 is compressed, and the moving frame 40 slides upward along the guide ribs 33 of the fixing frame 30 (referring to FIG. 2 and the direction arrows A of FIG. 5), so that the first support roller 23 and the second support roller 25 become further separated from each other. Accordingly, although the heating belt 22 becomes lengthened due to expansion by heat or deformation by prolonged use, the tension of the heating belt 22 can be maintained constant.

Figure 6:
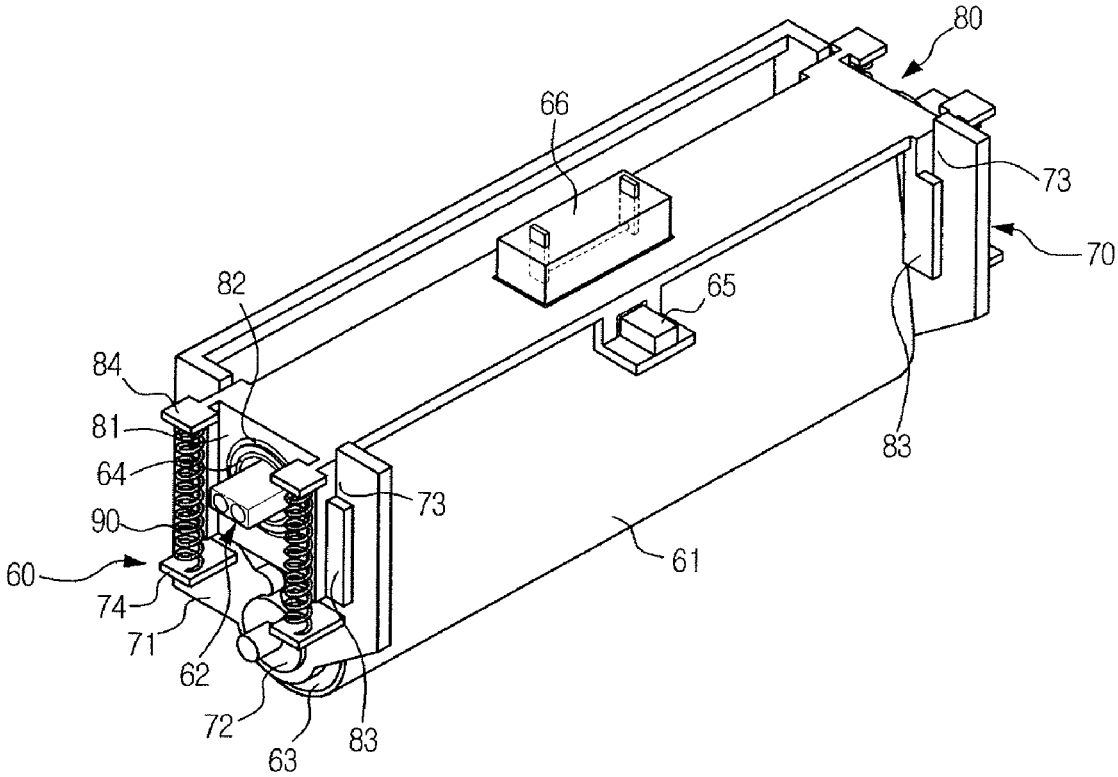
FIG. 6 is a perspective view schematically illustrating components of a fusing unit of an image forming apparatus in accordance with an embodiment of the present general inventive concept.

FIG. 6 is a perspective view schematically illustrating components of a fusing unit in accordance with an embodiment of the present general inventive concept. A fusing unit 60 of this embodiment has many common components of the fusing unit 20 of the first embodiment, but includes several alternative components, as discussed below. In this embodiment, an alternative elastic support device 90 and a connecting structure of the elastic support device 90 are illustrated in FIG. 6. The fusing unit 60 includes a press roller 21 (referring to FIG. 5), a heating belt 61 which circulates while closely contacting the press roller 21, and a heater 62 to heat the heating belt 61. The heating belt 61 is circulatingly supported on first and second support rollers 63 and 64.

Similarly to the fusing unit 20 of the first embodiment, the first support roller 63 is rotatably mounted to a fixing frame 70, and the second support roller 64 is rotatably mounted to a moving frame 80 which is coupled to the fixing frame 70. The fixing frame 70 is provided with support brackets 71 at opposing end portions, and bearings 72 are provided at each respective support bracket 71. Each end portions of the first support roller 63 are respectively coupled to a respective bearing 72, where the bearing is similar to the bearing 32 of FIG. 2, as described above. The moving frame 80 is provided with bearing support portions 81 at opposing end portions, and bearings 82 are mounted to the bearing support portions 81. Both end portions of the second support roller 64 are respectively coupled to a bearing 82. A temperature sensor 65 to detect a temperature of the heating belt 61 and an overheating prevention device 66 to automatically interrupt electric power applied to the heater 62 when the heating belt 61 overheats, are mounted to the moving frame 80.

Each end portion of the fixing frame 70 is provided with plural guide ribs 73, and the end portions of the moving frame 80 are each provided with guide rails 83 corresponding to the guide ribs 73. The moving frame 80 can slide up and down along the guide ribs 73. Plural elastic support devices 90 are mounted between the fixing frame 70 and the moving frame 80, to elastically support the moving frame 80 so that the second support roller 64 is biased away from the first support roller 63.

Differently from the elastic support devices 50 of the fusing unit 20 according to the embodiment of FIGS. 2-5, each of the elastic support devices 90 of this embodiment are configured as a compression spring which pushes the moving frame 80 in a direction away from the first support roller 63. One end of each of the elastic support devices 90 may be fixedly attached to a first fixing bracket 74 provided at an end portion of the fixing frame 70, and another end of each of the elastic support devices 90 may be fixedly attached to a second fixing bracket 84 provided at an end portion of the moving frame 80. Other than being configured as a compression spring, the elastic support devices 90 may be configured as any other elastic device which provides a pushing force equivalent to that of the compression spring.

In the fusing unit 60 of this embodiment as described above, since the second support roller 64 is elastically supported in a direction away from the first support roller 63, the tension of the heating belt 61 circulatingly supported on the first and second support rollers 63 and 64 can be constantly maintained.

The present general inventive concept is not restricted to a structure in which the first and second support rollers circulatingly supporting the heating belt are respectively mounted to the fixing frame and the moving frame, where the moving frame is movably mounted to the fixing frame. The first and second support rollers may be mounted to be biased away from each other by various different structures. Also, the elastic support devices can maintain a constant tension of the heating belt by biasing the first and second support rollers away from each other by various different connecting structures. The elastic support devices may be connected to either the first support roller or the second support roller, or may be connected to both of them.

Further, the present general inventive concept is not restricted to a structure which provides a pressing of the first support roller toward the press roller to closely contact the heating belt to the press roller, as described in the above embodiments. In other words, without aligning the first and second support rollers and the press roller with each other as illustrated in FIG. 4, the first and second support rollers may otherwise be disposed such that a portion of the heating belt located between the first and second support rollers closely contacts the press roller.

In the above description, a laser printer has been exemplified as the image forming apparatus according to the present general inventive concept. However, the present general inventive concept can also be applied to any other electrophotographic image forming apparatus having a fusing unit, such as a copying machine, a multi-function printer, a fax machine, or the like.

As apparent from the above description, the image forming apparatus according to the present general inventive concept can maintain a constant tension of the heating belt constant even when the heating belt is lengthened, because the elastic support devices apply an elastic force to the first support roller and the second support roller, which circulatingly support the heating belt, in a direction away from each other. Accordingly, a resistance to the circulation of the heating belt is decreased when compared to a conventional apparatus which uses a tension roller and a cleaning roller which press the heating belt.

Further, since it is not necessary with the present general inventive concept to install an expensive tension roller and cleaning roller, manufacturing costs are reduce. Still further, since the present structure is simple, operational trouble does not easily occur.

Although embodiments of the present general inventive concept have been illustrated and described, it would be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

a photosensitive body on which to form an electrostatic latent image;

an exposure device to irradiate light to the photosensitive body to form the electrostatic latent image;

a developer adhering device to adhere a developer to the photosensitive body, on which the electrostatic latent image has been formed, to form a visible image;

a transfer device to transfer the visible image formed on the photosensitive body onto a printing medium; and a fusing unit which includes:

a press roller;

a heating belt to closely contact the press roller to form a fusing nip to apply heat and pressure to the printing medium onto which the visible image has been transferred;

a first support roller that is rotatably supported by a fixing frame having a plurality of guide ribs, and a second support roller that is rotatably supported by a moving frame having pairs of guide rails to form guide slots, the moving frame slidably coupled to the fixing frame by the plurality of guide ribs respectively moving in the guide slots of the guide rails, the first and second support rollers disposed apart from each other to circulatingly support the heating belt; and an elastic support device to elastically bias the first support roller and/or the second support roller in a direction away from each other to maintain a substantially constant tension of the heating belt.

2. The image forming apparatus of claim 1, wherein the elastic support device is configured as a tension spring to pull the first support roller and/or the second support roller away from each other.

3. The image forming apparatus of claim 1, wherein the elastic support device is configured as a compression spring to push the first support roller and/or the second support roller away from each other.

4. The image forming apparatus of claim 1, wherein the elastic support device elastically supports the moving frame to bias the second support roller away from the first support roller.

5. The image forming apparatus of claim 4, wherein the elastic support device is mounted in plural numbers at respective end portions of the fixing frame and the moving frame.

6. The image forming apparatus of claim 4, wherein the second support roller is provided with a connecting pipe at a respective end portion, and each connecting pipe is respectively rotatably coupled to a corresponding end portion of the moving frame, and is provided with a belt guide portion to guide a respective side of the heating belt to allow the heating belt to circulate without the heating belt being biased to one side of the second support roller.

7. The image forming apparatus of claim 1, wherein the second support roller is configured as a hollow pipe, and the heater is mounted in an interior portion of the second support roller.

8. The image forming apparatus of claim 1, wherein the first support roller is provided with an elastic layer on a surface thereof, the elastic layer being elastically deformed when closely contacting the press roller.

9. A fusing unit of an image forming apparatus, comprising:

a press roller;

a heating belt to closely contact the press roller to form a fusing nip to apply heat and pressure to the printing medium onto which a visible image has been transferred;

a first support roller that is rotatably supported by a fixing frame having a plurality of guide ribs, and a second support roller that is rotatably supported by a moving frame having pairs of guide rails to form guide slots, the moving frame slidably coupled to the fixing frame by the plurality of guide ribs respectively moving in the guide slots of the guide rails, the first and second support rollers disposed apart from each other to circulatingly support the heating belt; and an elastic support device to elastically bias the first support roller and/or the second support roller in a direction away from each other to maintain a substantially constant tension of the heating belt.

10. The fusing unit of claim 9, wherein the elastic support device is configured as a tension spring to pull the first support roller and/or the second support roller away from each other.

11. The fusing unit of claim 9, wherein the elastic support device is configured as a compression spring to push the first support roller and/or the second support roller away from each other.

12. The fusing unit of claim 9, further comprising:

wherein the elastic support device elastically supports the moving frame to bias the second support roller away from the first support roller.

13. The fusing unit of claim 12, wherein the elastic support device is mounted in plural numbers to a respective first and second end portion of the fixing frame and the moving frame.

14. The fusing unit of claim 12, wherein the second support roller is provided with a connecting pipe on a first and second end portion of the second support roller, and each connecting pipe is respectively rotatably coupled to a respective first and second end portion of the moving frame, and are provided with belt guide portions to guide each side of the heating belt to circulate without being biased to either side of the second support roller.

15. The fusing unit of claim 9, wherein the second support roller is configured as a hollow pipe, and the heater is mounted within an interior portion of the second support roller.

16. The fusing unit of claim 9, wherein the first support roller is provided with an elastic layer on a surface thereof, the elastic layer being elastically deformed when closely contacting the press roller.

17. An image forming apparatus, including:

an image forming unit to form a visible image to be printed on a printing medium;

a fusing unit to fuse the visible image on the printing medium, and including a heating belt and a tension adjusting unit, the tension adjusting unit having:

a first support roller that is rotatably supported by a fixing frame having a plurality of guide ribs, and a second support roller that is rotatably supported by a moving frame having pairs of guide rails to form guide slots, the moving frame slidably coupled to the fixing frame by the plurality of guide ribs respectively moving in the guide slots of the guide rails, the first and second support rollers to support and circulate the heating belt such that one of the support rollers provides the heating belt with a bias force to maintain a substantially constant tension on the heating belt.

18. The image forming apparatus of claim 17, wherein the fusing unit comprises:

a sensor unit extended from one of the frames to be disposed close to the heating belt to detect a temperature of the heating belt.

19. The image forming apparatus of claim 17, wherein the support rollers are moved away from each other via the bias force which is a pushing bias force.

20. The image forming apparatus of claim 17, wherein the support rollers are moved away from each other via the bias force which is a pulling bias force.

* * * * *